US006073519A

United States Patent [19]

Presa Eguren

[11] Patent Number: 6,073,519

[45] Date of Patent: Jun. 13, 2000

[54] PORTABLE CORKSCREW

[76] Inventor: Jacinto Presa Eguren, Jaime E1 Conquistador, 21, 28045 Madrid, Spain

[21] Appl. No.: 08/903,192

[22] Filed: Jun. 24, 1997

Related U.S. Application Data

[63] Continuation of application No. PCT/ES96/00197, Jun. 24, 1997, abandoned.

[30] Foreign Application Priority Data

Oct. 19, 1995 [ES] Spain ..... 9502688 U

[51] Int. Cl.[7] ..... B67B 7/04

[52] U.S. Cl. ..... 81/3.33; 81/3.29

[58] Field of Search ..... 81/3.29, 3.07, 81/3.08, 3.33, 3.35, 3.36, 3.37, 3.45

[56] References Cited

U.S. PATENT DOCUMENTS 728,519 5/1903 Tscherning .
728,520 5/1903 Tscherning .
728,642 5/1903 Wiles .
814,641 3/1906 Comber .
2,522,219 9/1950 Gaeta .

FOREIGN PATENT DOCUMENTS 604312 5/1960 Italy .

*Primary Examiner*—D. S. Meislin
*Attorney, Agent, or Firm*—Michael J. Strker

[57] ABSTRACT

A portable corkscrew has a body provided with an axial stepped hole where a plunger assembly has been housed and provided with a housing in which a cap appears which, at its lower end, supports a helicoidal rod, while at its upper face it leans against a spherical surface housed in a hole formed in a piece internal to the plunger and provided with a transverse hole to which a manually actuable external lever has been articulated by a pin, the plunger being further provided with two lateral holding elements which at its upper side end are pivotally articulated by means of respective axles against the action of associated springs while the lower ends of these holding elements have been shaped as hooks with their spikes being outwardly directed, this assembly being capable of longitudinal displacement when the mentioned external lever is manually operated.

8 Claims, 1 Drawing Sheet

PORTABLE CORKSCREW

This application is a continuation application of PCT application PCT/ES96/00197 now abandoned.

BACKGROUND OF THE INVENTION

The present invention refers to an improved portable corkscrew which presents essential characteristics of novelty, as well as important advantages with respect to those similar means known and used in the current state of the art.

The application field of the present invention is that of the manufacturing industry of household items and complements and for the generally specialized industry, such as the restoration field.

Several types of corkscrew are known in the market, which are used to extract the closing corks in bottles mainly containing wine and similar liquids. Within this type of known corkscrews, some of them incorporate a helicoidal rod which after having been introduced into the cork to be extracted, their displacement is caused in the extraction sense by manually acting on external levers.

However, it has been proved that in practice when the cork closing the bottle has greater hardness or is introduced at a greater pressure, it is very frequent that in these types of known corkscrews, when pressure is made over the external levers to cause the release of the cork, the mentioned helicoidal extraction rod rotates in the opposite direction to that of its introduction in the cork, due to resistance to the displacement offered by the cork, such that the desired effect of uncorking from the bottle in question is not produced. Subsequent attempts result in the formation of a gap between the helicoidal rod and the cork body, eventually completely eliminating the possible effectiveness of these corkscrews due to the breakage of the cork itself.

SUMMARY OF THE INVENTION

Consequently, and to eliminate the drawbacks of the type mentioned above, it would be desirable to have a corkscrew whose helicoidal rod could not rotate in the opposite direction to that of its introduction when corks were extracted, which depending on their characteristics or due to the specific conditions of introducing the cork, this offers a high resistance to extraction such that on avoiding said undesired rotation, the uncorking operation is guaranteed and may be executed in a really efficient way.

This invention has developed an improved portable corkscrew combining the aforementioned characteristics and considered as desirable. For this purpose, the corkscrew has an internally hollow, suitable body, according to a stepped axial hole, where several elements comprising the corkscrew device are housed. Externally, the body is closed at its upper part and has a smooth shape except those parts which are slightly protruding from the lateral tightening levers, whose external shape is undulated to permit a better adaptation to the user's hand, the lower end of the body being open to present a hole for the introduction of the bottle neck whose uncorking is desired. The mentioned inner device of the corkscrew is actuated by means of an external lever and is comprised by two differentiated sections, namely, an upper one and a lower one, of which the upper one consists of a plunger over which the mentioned external lever acts, said plunger having a housing where a cover holding the extracting helicoidal rod supported on an element with a spherical surface, for example a ball, to facilitate the rotation of said cover holding the helicoidal rod, and said plunger further carring two holding and engaging lateral means which at their respective upper ends are pivotally articulated to the plunger, against the action of related springs, while at their lower ends they adopt the shape of hooks opened to the outside, while the lower section consists of a nut equipped with means of anti-rotation during its displacements inside the corkscrew body, across which passes the mentioned helicoidal rod and against whose lower surface the upper edge of the bottle neck is supported and, if pertinent, the upper surface of the cork to be extracted. This nut has a hole through it upper face shaped in such a way that it allows the engagement in its interior of the lower ends of the means for retention and engagement related to the upper shank. Moreover, the assembly has foreseen the installation of two lateral levers, which the hand presses when the uncorking operation is made and the consequent removal of the extracted cork, these levers being articulated in a pivotable manner to the corkscrew body near their respective upper ends, against the action of recovering springs, placed at said upper ends and each one of these levers having two points or spikes superimposed through their opposite internal edges, in corresponding positions, of which the upper spike of each lever faces the area of the nut foreseen for engagement of the lower ends of the holding elements of the upper plunger when the corkscrew is in the rest position. The possibility of movement of these lateral levers corresponds to a short run limited by the shape of its own housing in the corkscrew body.

BRIEF DESCRIPTION OF DRAWINGS

Below there is a detailed description of the object of the invention, made on the basis of the attached drawings where, as an example and without a limiting character, a preferred embodiment of the invention has been represented. In such drawings.

DESCRIPTION OF THE PREFERRED EMBODIMENT

Figure 3:
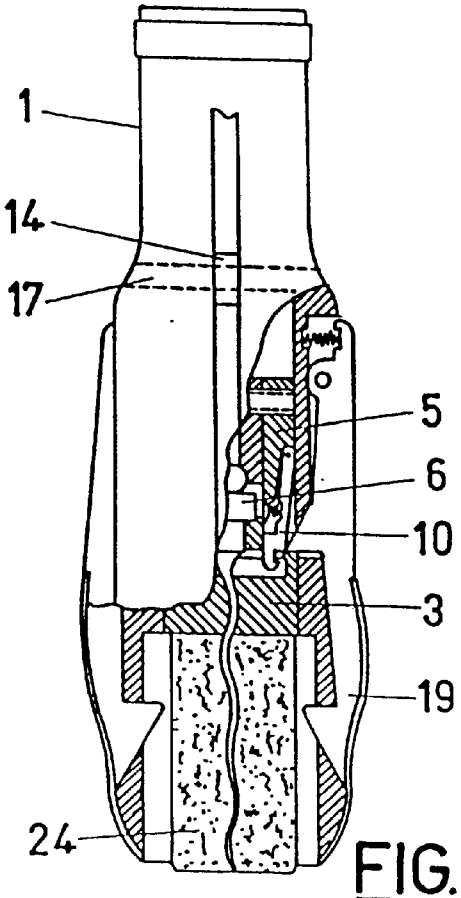
FIG. 3 is an elevational view, likewise in a partial section of the corkscrew of the invention where its inner device is positioned according to the last stage of the process, after extraction of a cork from a bottle.

To make the detailed description of the preferred embodiment of the present invention, permanent reference shall be made to the drawings commented above. Hence, first of all considering FIG. 1, a representation of an elevational view appears in it according to a longitudinal section made in the body (1) of the corkscrew of the present invention, where the different elements comprising the device of said corkscrew are represented. The mentioned body (1) is hollow internally according to a stepped axial hole, open at its lower end to receive the bottle neck holding the cork to be extracted, while at its upper end it appears closed by means of a suitable horizontal wall (2) and, preferably, externally simulates the same shape of a bottle. Within the body (1), there is a nut (3), which may be displaced longitudinally and which is provided with an anti-rotational means (4) preferably consisting, as may be seen in FIG. 2, of a suitable screw preventing that said nut (3) may rotate when it is displaced along its longitudinal run, it having been foreseen in said nut, at its upper face, a hole with a profile adapted to permit the engagement of holding means. In the upper part of the body (1), a plunger (5) is housed provided with a hollow where a cover (6) is housed, that at its lower part supports the helicoidal extraction rod (7), said head portion (6) being supported by its upper face against a spherical surface, preferably a ball (8) which is housed in a hole of the part (9) internal to the plunger (5), which evidently provides the head portion (6) and the related rod (7) the possibility of freely and smoothly rotating. At both sides and in diametrically opposite positions, the plunger (5) incorporates two holding elements (10), which at their upper end are pivotally articulated to the plunger (5) by means of axles (11) and whose lower ends are shaped as a hook ending in outwardly directed spikes, adapted to engage in the inside of the upper hole of the mentioned nut (3). These holding elements (10) have in their pivoting movement with respect to their respective axle (11) a limited run along the same walls of the body (1) and the plunger (5), this movement being made against the action of springs (12). The mentioned part (9) internal to the plunger (5) has a transverse hole (13) where a pin is housed to fix the manually actuable external lever (14) which at its free end is provided with a handle (15). This external lever may be rotated with respect to the pin (13) and has the end opposite to the externally articulated handle by means of the pin (17) to the upper end of a new lever (16) which, in turn, is articulated to the body (1) at is lower end by means of an axle (18).

Within the body (1) and at both sides thereof, two lateral levers (19) have been foreseen which are articulated to said body near their upper ends by means of axles (20) and which incorporate at said upper end respective springs (21) supported by the same wall of the body. These levers (19) have their external edge preferable undulated to permit their better adaptation to the user's hand and have a short limited run through the same space where they are housed, being used as means to release the nut (3) with respect to the holding means (10) of the upper plunger (5) and also as holding means of the bottle holding the cork to be extracted. For this purpose, both lateral levers (19) incorporate two projections (22, 23) in their internal edge in the form of spikes directed towards the inside, one projection (22) of which is faced to the housing for the nut (3), in which housing the ends of the holding elements (10) are engaged, whilst the respective lower projections (23) have been adapted to hold the neck of a bottle (25) carrying the cork (24) to be extracted.

Figure 1:
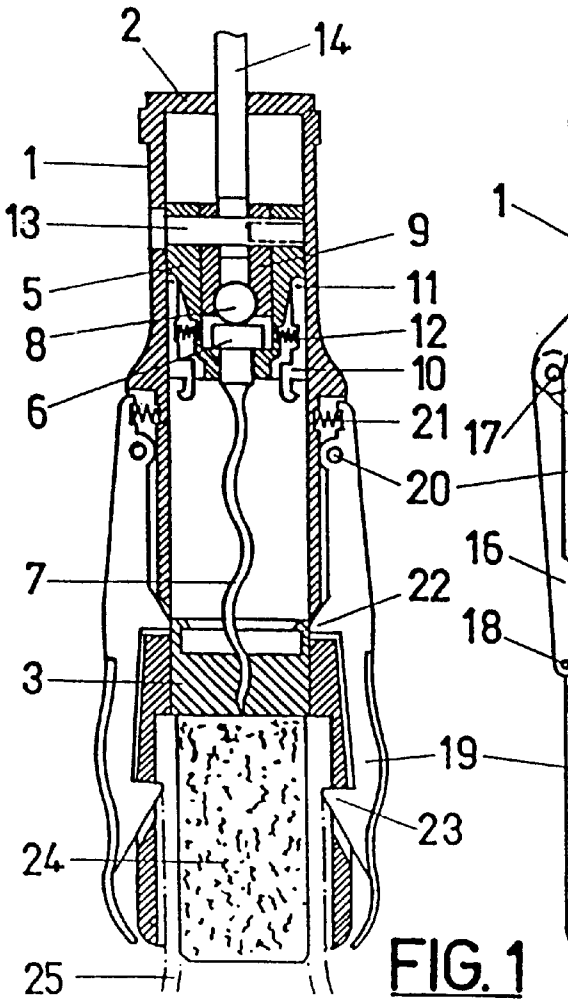
FIG. 1 shows an elevational view of a longitudinal section made in the corkscrew of the present invention.

In the mentioned FIG. 1, the corkscrew appears ready to be used to extract a cork (24) from a bottle (25) whose neck has been introduced through the lower open end of the body (1) of the corkscrew. In these conditions and in pursuance of the pressure made by the user's hand over the corkscrew body, the lateral levers (19) will have pivoted towards the inside against the action of the respective springs (21), until its lower projections or spikes (23) reach the external wall of the bottle neck (25). In this position, the upper projections or spikes (22) are opposite the housing of the nut (3) but sufficiently spaced from said nut. On pressing the handle (15) of the external lever (14) and pivoting the latter with respect to the axle (13) until the position represented with points in FIG. 2, the plunger (5) is displaced downwardly and the helicoidal rod (7) is introduced in the cork (24). When the external lever reaches the end of its run, the holding elements (10) related to the plunger (5) and which have descended with it, introduce their lower ends in the form of a hook inside the upper hole made in the mentioned nut (3), pivoting with respect to its axle (11) against the action of the springs (12) and engaged to said nut (3) thanks to the recovering action of said springs. In this way, the assembly related to the plunger (5) is secured to the nut (3).

If the handle (15) of the external lever (14) is now lifted, the plunger (5)/nut (3) assembly will be lifted, together with the helicoidal rod (7), dragging the latter in its run upwards to the cork (24) of the bottle (25). The mentioned helicoidal rod (7) cannot rotate in a sense opposite to its introduction, due to the block formed by the plunger (5) and nut (3) assembly, such that the extraction of said cork is guaranteed. Then, the lateral levers (19) are released from the manual pressure made over them, such that the recovery of the related springs (21) make them pivot in an opposite direction, such that the projections or spikes (23) lose contact with the bottle neck (25) and allow said bottle to be extracted from the inside of the body (1).

Figure 2:
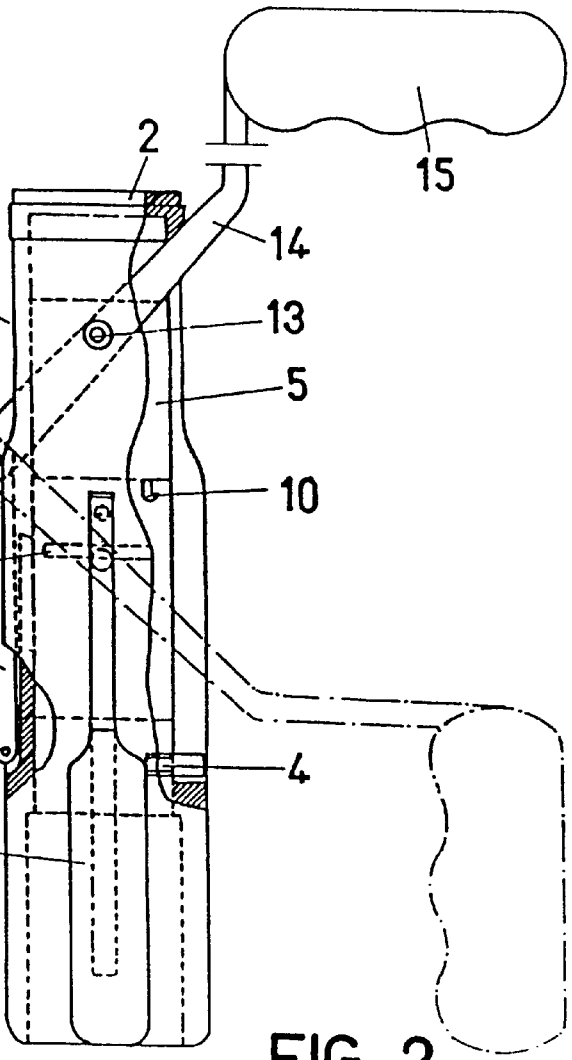
FIG. 2 represents an elevational view of the corkscrew of the invention, with some sectioned parts, where the manually actuable external lever may be observed, represented in its two extreme positions.

If then the external lever (14) is moved again to the second position to the points shown in FIG. 2, the block formed by the assembly of plunger (5) and nut (3), together with the cork (24) extracted from the bottle (25) shall pass to occupy the position shown in FIG. 3. In this position, by making a slight manual pressure on the lateral levers (19), the projections (23) will not now limit the run of said levers because inside the body (1) there is no bottle, such that these levers will have a greater run, and the projections or spikes (22) will reach the position of the lower ends of the holding elements (10) of the plunger (5), pressing over said lower ends and releasing the plunger/nut coupling. Under these new conditions, the helicoidal rod (7) will be free to rotate, such that by manually lifting the handle (15) of the external lever (14), the upwards displacement of the plunger (5) assembly will be actuated, the cork (24) being retained by said nut (3) which cannot ascend now due to the fact that it is now prevented by the own projections (22) of the lateral levers (19), whereby the cork (24) is released and it may be finally extracted without any difficulty, the assembly being again in the position illustrated in FIG. 1, ready to effect a new extraction.

The above disclosure is referred to a preferred embodiment of the present invention which is only limited by the appended claims.

I claim:

1. An improved portable corkscrew, comprising a body provided with a lower hole in which a neck of a bottle carrying a cork to be extracted is introduceable; a helicoidal rod introducable in the cork; an external lever provided with an end handle to be manually operated during an extraction operation of the cork, said body having an inside hollow formed as an axial stepped hole; a plunger assembly housed in said axial step hole and provided with a housing; a head portion lying in said housing and having a lower end which supports said helicoidal rod, and an upper face engaging a spherical surface housed in a hole formed in a piece integral to said plunger, said piece of said plunger being provided with a transverse hole to which said manually actuatable external lever is articulated by a pin, said plunger being further provided with two lateral holding elements each having an upper end pivotably articulated to said plunger by means of respective axles against an action of associated springs, while lower ends of said holding elements are shaped as hooks with spikes, said spikes being directed outwardly, and said assembly being capable of longitudinal displacement when said external lever is manually operated.

2. An improved portable corkscrew as defined in claim 1, and further comprising a nut located in said axial hole of said body and having an upper end provided with a hole shaped to facilitate an engagement of said lower ends of said holding elements.

3. An improved portable corkscrew as defined in claim 1, and further comprising a second rear lever, said external lever being pivotably articulated at an internal end and by an axle to said second lever, said second lever having a lower end articulated to said body by an axle.

4. An improved portable corkscrew as defined in claim 2, and further comprising two lateral levers pivotably articulated to said body near an upper end of said body by respective axles against an action of associated springs manually pressable from outside, each of said lateral levers having an internal edge with two inwardly directed projections including an upper projection and a lower projection, said upper projections facing to said hole of said nut, while said lower projections are arranged to lean against the neck of the bottle which carries the cork to be extracted.

5. An improved portable corkscrew as defined in claim 2, wherein said external lever is formed so that a manual operation of said external lever causes a displacement of said plunger assembly, while said lower ends of said lateral holding elements associated to said plunger are introduced in said hole of said nut to secure said nut and to drag said nut with its subsequent longitudinal displacement.

6. An improved portable corkscrew as defined in claim 4, wherein said upper projections of said lateral levers are formed so that they release said lower ends of said holding elements of said plunger with respect to said nut.

7. An improved portable corkscrew as defined in claim 4, wherein said upper projections of said lateral levers are formed so as to retain said nut during the operation to release the extracted cork with respect to said helicoidal rod.

8. An improved portable corkscrew as defined in claim 2, wherein said nut is provided with anti-rotational means.

* * * * *